US006227506B1

(12) United States Patent
Benedict

(10) Patent No.: US 6,227,506 B1
(45) **Date of Patent: *May 8, 2001**

(54) BRACKET ASSEMBLY

(76) Inventor: Paul R. Benedict, 48 Wilderness Lake Ct., Milford, MI (US) 48380

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/282,077

(22) Filed: Mar. 30, 1999

(51) Int. Cl.[7] ..... A47G 29/02

(52) U.S. Cl. ..... 248/249; 248/240; 248/251; 211/90.01

(58) Field of Search ..... 248/249, 250, 248/235, 302, 247, 248, 251, 240, 240.3; 211/90.01, 106, 105.1, 105.2; 108/152, 42

(56) References Cited

U.S. PATENT DOCUMENTS

| | | | | |
|---|---|---|---|---|
| 116,023 | | 6/1871 | Christian | 297/142 |
| 143,228 | | 9/1873 | Doyle | 248/240 |
| 171,226 | * | 12/1875 | Jones | 248/240 |
| 560,884 | * | 5/1896 | Anderson | 248/249 |
| 790,793 | * | 5/1905 | Koch | 248/240 |
| 920,633 | * | 5/1909 | Oppenheimer | 248/249 |
| 1,089,882 | * | 3/1914 | Thomas | 211/96 |
| 1,284,235 | | 11/1918 | Carlin | 248/317 |
| 1,576,227 | * | 3/1926 | Rundle | 248/240 |
| 1,579,556 | * | 4/1926 | McKenzie | 211/90.01 |
| 2,231,128 | | 2/1941 | Krantz | 248/215 |
| 2,805,779 | | 9/1957 | Caverley | 211/96 |
| 3,702,591 | | 11/1972 | Banse | 108/31 |
| 4,777,888 | | 10/1988 | Waterman | 108/108 |
| 4,913,297 | | 4/1990 | Wells | 211/96 |
| 5,351,842 | * | 10/1994 | Remmers | 211/106 X |
| 5,706,737 | * | 1/1998 | Whitehead | 108/42 |

* cited by examiner

*Primary Examiner*—Ramon O. Ramirez
*Assistant Examiner*—Gwendolyn Baxter
(74) *Attorney, Agent, or Firm*—Kevin G. Mierzwa

(57) ABSTRACT

A bracket assembly for assembly to a wall has a pair of wall mounts each having receiving channels for receiving a portion of a bracket structure. The bracket structure has a unitary bracket structure having a first coupling portion sized to be received within said first receiving channel, a shelf support portion, extending from said first coupling portion, a pole support portion adjacent the shelf support portion, an angular portion and a second coupling portion adjacent to said angular portion. Several brackets may be assembled on a wall and used to support a pole or shelf or both.

6 Claims, 3 Drawing Sheets

BRACKET ASSEMBLY

TECHNICAL FIELD

The present invention relates generally to brackets. More specifically, the present invention relates to a bracket assembly for supporting shelves, hanging rods or tools.

BACKGROUND OF THE INVENTION

Shelves for closets often have brackets which support a shelf and a clothes hanging rod. Numerous cantilever shelf/clothes rod arrangements are known. One type of arrangement uses an integrally formed shelf and rod arrangement that is continuous. This arrangement is designed to be mounted to the wall in a permanent location. One problem with such an arrangement is that when not in use, this shelf apparatus may not easily be moved out of the way. Thus, this shelf apparatus may be stored for later use.

Other types of shelving arrangements are formed from metal wire. The brackets that are used to hold the shelf in place usually are interleaved with the wire shelving. This forces the brackets to be placed in certain positions with respect to the shelving. When mounting shelving, it is desirable to secure the brackets to studs to allow the bracket maximum support. Because of the forced positions, a stud may not always align with a bracket position. Another problem associated with such brackets is that they are securely attached to the shelving unit and with respect to the wall. This prevents the shelving unit from being easily removed when not in use.

SUMMARY OF THE INVENTION

It is, therefore, one object of the invention to provide a shelving unit which may be easily attached to wall structures such as studs. It is a further object of the invention to provide a bracket structure that allows the bracket to be easily moved out of place when the bracket or shelf is not in use.

In one aspect of the invention, a bracket assembly for assembling to a wall has a first wall mount having a first receiving channel therein, and a second wall mount having a second receiving channel therein. This bracket assembly has a unitary bracket structure that has a first portion sized to be received within the first receiving channel, a shelf support portion extending from the first coupling portion, a pole support portion adjacent to the shelf support portion, an angular support portion coupled to the shelf support portion, and a second coupling portion adjacent to the angular portion.

In a further aspect of the invention, a shelving assembly for mounting between a ceiling and a wall has a first wall mount having a first receiving channel and the first ceiling mount having a second receiving channel therein, a second wall mount having a third receiving channel therein, and a second ceiling mount having a fourth receiving channel therein. The assembly includes a first unitary bracket structure has a first coupling portion sized to be received within the first receiving channel and a second coupling portion sized to be received within the second receiving channel. The first unitary bracket structure has a first arm and second arm extending substantially perpendicular to each other and coupled to a respective first coupling portion and a second coupling portion. A second unitary bracket structure has a third coupling portion sized to receive within the third receiving channel, and a fourth coupling portion sized to receive within the fourth receiving channel. The second unitary bracket structure has a second support having a third arm and a fourth arm extending substantially perpendicular to each other and coupled to a respective third coupling portion and a fourth coupling portion. A shelf is supported between the first arm and third arm.

One advantage of the invention is that the brackets may be rotated out of the way against a wall when not in use.

Another advantage of the invention is that only two fasteners are required. The two fasteners may be easily located along a vertical line coinciding with a stud in the wall.

Other objects and features of the present invention will become apparent when viewed in light of the detailed description of the preferred embodiment when taken in conjunction with the attached drawings and appended claims.

DETAILED DESCRIPTION OF THE PREFERRED EMBODIMENT

Figure 1:
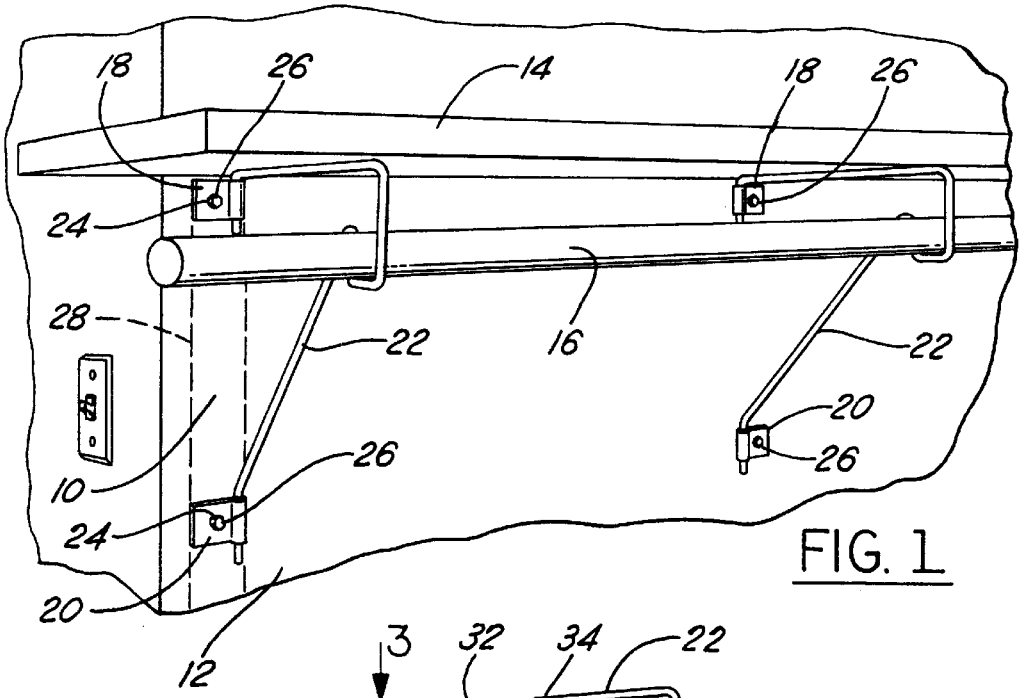
FIG. 1 is a perspective view of a bracket assembly according to the present invention.

Referring now to the drawings, like reference numerals are used to identify identical components in the various views. While a preferred embodiment is illustrated with respect to a bracket for holding a shelf and pole, the bracket may be used to support tools, plants or other items.

Figure 2:
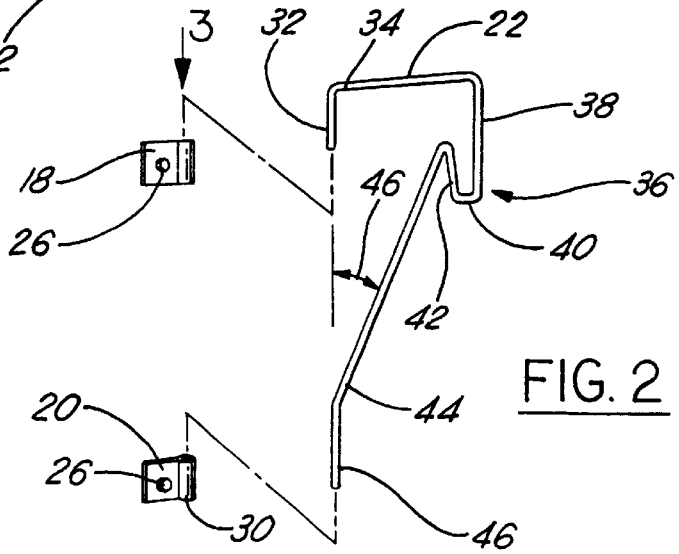
FIG. 2 is an exploded view of a bracket and wall mount.
Figure 3:
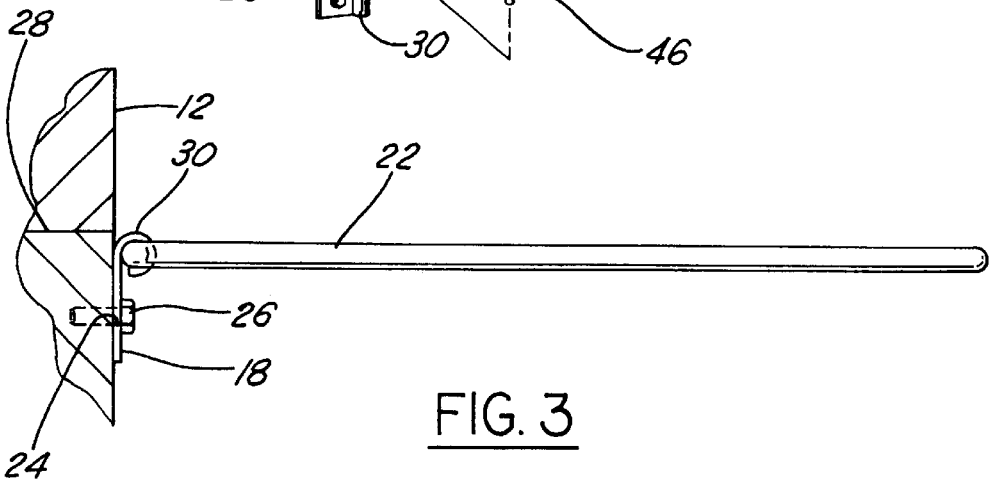
FIG. 3 is a top view of a bracket and wall mount.

Referring now to FIGS. 1–3, a bracket assembly 10 is shown mounted to a wall 12. Bracket assembly 10 may be used to support a shelf 14 and a hanging pole 16. Of course, a bracket assembly may be used with either shelf 14 or a hanging pole 16. Bracket assembly may be used as a hanger to support a plant.

Bracket assembly 10 has a first wall mount 18 and a second wall mount 20 that are used to support a unitary bracket 22. First wall mount 18 and second wall mount 20 have fastener openings 24 extending therethrough. Fastener openings 24 are sized to receive a fastener 26. In the preferred embodiment, fastener openings 24 of first wall mount 18 and second wall mount 20 are aligned with a stud 28 within wall 12. This allows a maximum amount of support to be provided to bracket 22. Of course, bracket 22 may be positioned adjacent a wall without a stud. In such a case, anchor 20 may be used to support bracket 22.

First wall mount 18 and second wall mount 20 each have a receiving channel 30. As is best shown in FIG. 3, receiving channel 30 is preferably integrally formed with first wall mount 18. For example, if wall mount 18 is formed from a metallic material, the receiving channel 30 may be formed by bending a portion of first wall mount material to form receiving channel 30 therein.

Bracket 22 is preferably formed of a unitary structure. In the preferred embodiment, bracket 22 may be formed of a metallic structure. Bracket 22 may have a coating of plastic or paint to improve aesthetic appeal and improve corrosion resistance if formed of steel.

The structure of bracket 22 includes a first coupling portion 32 sized to be received within receiving channel 30 of first wall mount 18. First coupling portion 32 may be parallel to the direction of stud 28. Bracket 22 has a shelf support portion 34 extending from first coupling portion 32. The length of shelf support portion 34 should be approximately the size of the width of shelf 14. Preferably, shelf support portion 34 extends in a perpendicular direction from first coupling portion 32. When holding a shelf, shelf support portion 34 preferably extends substantially perpendicular to wall 12.

Bracket 22 has a pole support portion 36. Pole support portion 36 is substantially J-shaped. As shown, pole support portion 36 has a vertical member 38 coupled to a horizontal member 40 which is coupled to another vertical member 42. Vertical member 38 extends from shelf support portion 34. Preferably, vertical member 38 extends in a perpendicular direction from shelf support portion 34. Horizontal member 40 extends in a perpendicular direction from vertical member 38. Vertical member 42 extends in a perpendicular direction to horizontal member 40. Although three distinct members are shown forming pole support portion 36, a single rounded member having various angles with respect to its adjacent components would be evident to those skilled in the art.

Bracket 22 has an angular portion 44 coupled to pole support portion 36. Angular portion 44, for example, may be coupled to vertical member 42 of pole support portion 36. Angular portion 44 forms an angle 46 with wall 12. Angle 46 is preferably about 45°.

Bracket 22 has a second coupling portion 46 coupled to angular portion 44. Second coupling portion 46 is sized to be received within receiving channel 30 of second wall mount 20. Preferably, first coupling portion 32 and second coupling portion 46, if extended, would be collinear.

Fasteners 26 are illustrated as threaded fasteners. However, one skilled in the art would recognize that other types of fasteners may be used such as nails or adhesives so long as they are capable of supporting bracket and any load to be supported by the bracket.

Figure 4:
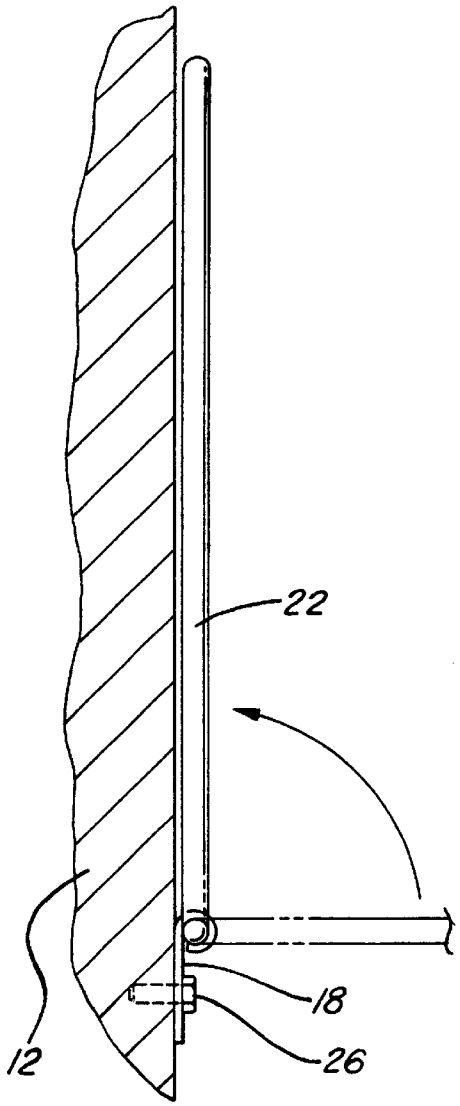
FIG. 4 is a elevational view of a bracket folded against a wall.

Referring now to FIG. 4, one advantage of the present invention is illustrated. That is, if shelf 14 or hanging pole 16 are temporarily not required, bracket 22 may be rotated within wall mount to be parallel to wall 12. This allows bracket 22 to be placed out of the way. When the bracket is desired to be used, bracket 22 may be rotated perpendicular to wall 12.

In operation of bracket assembly 10, first wall mount 18 and second wall mount 20 are preferably positioned along a vertical line and preferably adjacent to a stud 28. A screw, bolt or other type of fastener 26 is then inserted within fastener openings 24 to securely fasten first wall mount 18 and second wall mount 20 to the wall. The first coupling portion 32 and second coupling portion 46 are simultaneously inserted within first wall mount 18 and second wall mount 20. A number of first and second wall mounts and brackets 22 may be used to support a shelf. It is contemplated, however, that at least two brackets be used for each shelf. If length and load dictate, various numbers of brackets may be used. A shelf 14 may then be placed upon brackets and a hanging pole 16 may be inserted within pole support portion of the brackets.

Figure 5:
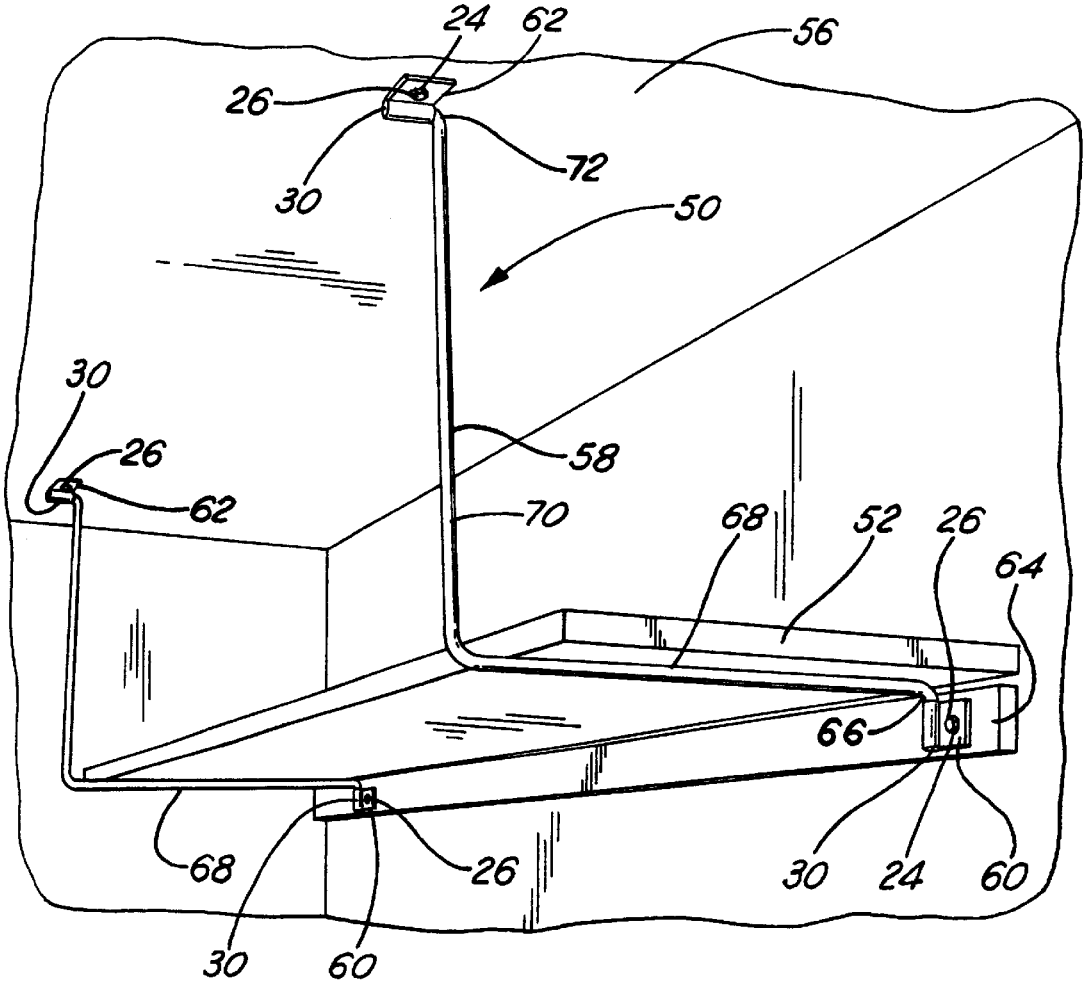
FIG. 5 is a perspective view of a shelf mount support supporting a shelf relative to a wall and ceiling.

Referring now to FIG. 5, a shelf mount assembly 50 is shown supporting a shelf 52 with respect to a wall 54 and a ceiling 56.

Shelf mount assembly 50 has a pair of unitary brackets 58, each end of which is coupled to a wall mount 60 and a ceiling mount 62, respectively. As shown, wall mount 60 is mounted to a horizontal piece of wood 64, rather than directly to wall 54. However, one skilled in the art would recognize that wall mount 60 may be mounted directly to a wall and to an underlying stud. Ceiling mount 62 and wall mount 60 are formed in a similar manner to that described above with respect to first wall mount 18 and second wall mount 60. That is, wall mount 60 and ceiling mount 62 have a fastener opening 24 sized to receive a fastener 26, and a receiving channel 30.

Brackets 58 have a first coupling portion 66 sized to be received within receiving channel 30 of wall mount 60. Bracket 58 further has a first arm 68 and a second arm 70. First arm 68 extends from first coupling portion 66. Preferably, first arm 68 is parallel to ceiling 56. Second arm 70 extends in a perpendicular direction to second arm 70. Preferably, second arm 70 is parallel to wall 54. Second arm 70 is coupled to a second coupling portion 72. Second coupling portion 72 is sized to be received within receiving channel 30 of ceiling mount 62. Shelf 52 is supported parallel to ceiling 56 upon first arm 68 of each bracket. It is contemplated that at least two brackets are used to support shelf 52. However, a single bracket 58 may be used if the opposite end of shelf is supported by some other means.

Bracket 58 is preferably formed of wire or other metallic structure such as that described above. It is contemplated that bracket 58 may be coated by paint or plastic to prevent corrosion and provide an aesthetically pleasing appearance.

Figure 6:
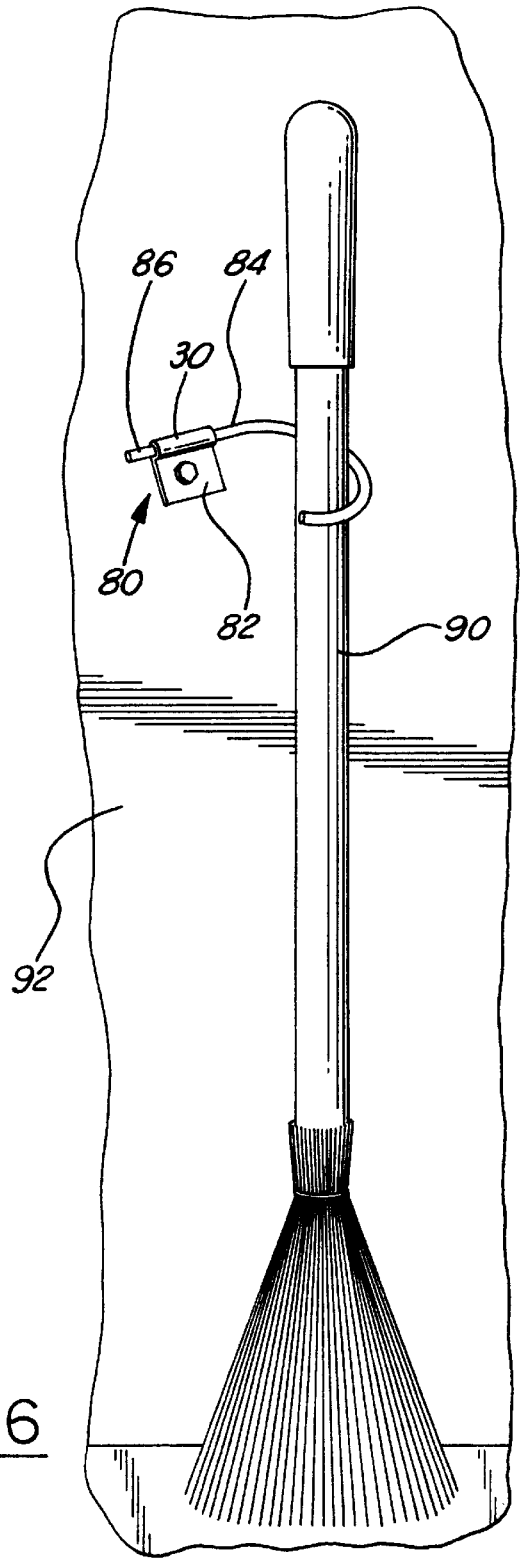
FIG. 6 is a perspective view of a tool holder according to the present invention.

Referring now to FIG. 6, a further extension of the invention is a tool holder assembly 80. Tool holder assembly 80 may be formed of a wall mount 82 and a unitary bracket structure 84. Wall mount 82 is formed in a similar manner to that of first wall mount 18 and second wall mount 20 as described above. Unitary bracket structure 84 has a first coupling portion 86 sized to be received within receiving channel 30 of mount 82. Bracket 84 has a J-shaped portion extending from coupling portion 86. J-shaped portion may be sized to receive a broom handle 90 or other tool.

Unitary bracket structure 84 holds broom handle 90 or other tool against wall 92. In one constructed embodiment, unitary bracket structure 84 is coated with a plastic-type material to prevent broom handle 90 or other tool from slipping with respect thereto.

While particular embodiments of the invention have been shown and described, numerous variations and alternate embodiments will occur to those skilled in the art. Accordingly, it is intended that the invention be limited only in terms of the appended claims.

What is claimed is:

1. A bracket assembly for assembling to a wall comprising:

a first wall mount having a first receiving channel therein;

a second wall mount having a second receiving channel therein; and a unitary bracket structure having a first coupling portion sized to be rotatably received within said first receiving channel, a shelf support portion extending perpendicular to said first coupling portion, a J-shaped pole support portion adjacent to and coupled to the shelf support portion, said J-shaped portion having a first vertical member coupled perpendicularly to said shelf support portion, a horizontal portion extending from said first vertical portion, and a second vertical portion coupled to said horizontal portion, an angular portion coupled to said second vertical portion, and a second coupling portion adjacent to said angular portion sized to be rotatably received with said second receiving channel, said unitary bracket rotatably coupled to said first wall mount and said second wall mount so that in a first position said unitary bracket extends substantially perpendicular to said wall and in a second position extends sustantially parallel to said wall.

2. The bracket assembly as recited in claim 1 wherein said angular portion forms a 45 degree angle with the wall.

3. The bracket assembly as recited in claim 1 further comprising a coating on said unitary bracket.

4. The bracket assembly as recited in claim 3 wherein said coating comprises a plastic.

5. The bracket assembly as recited in claim 3 wherein said coating comprises paint.

6. The bracket assembly as recited in claim 1 wherein said first wall mount and said second wall mount comprise a unitary structure.

* * * * *